United States Patent [19]

Hepworth

[11] Patent Number: 4,598,652

[45] **Date of Patent: * Jul. 8, 1986**

[54] COAL COMBUSTION TO PRODUCE CLEAN LOW-SULFUR EXHAUST GAS

[75] Inventor: Malcolm T. Hepworth, Golden, Colo.

[73] Assignee: Amax Inc., Greenwich, Conn.

[ * ] Notice: The portion of the term of this patent subsequent to Feb. 25, 2003 has been disclaimed.

[21] Appl. No.: 772,524

[22] Filed: Sep. 4, 1985

[51] Int. Cl.[4] ..... F23J 11/00; F23J 15/00

[52] U.S. Cl. ..... 110/345; 110/344; 110/347; 44/1 SR

[58] Field of Search ..... 110/342, 343, 344, 345, 110/347; 44/1 SR

[56] References Cited

U.S. PATENT DOCUMENTS

| | | | |
|---|---|---|---|
| 4,173,454 | 11/1979 | Heins | 110/342 |
| 4,377,118 | 3/1983 | Sadowski | 110/244 X |
| 4,388,877 | 6/1983 | Molayem et al. | 110/342 |

*Primary Examiner*—Edward G. Favors

*Attorney, Agent, or Firm*—Michael A. Ciomek; Eugene J. Kalil

[57] ABSTRACT

A process is provided for combusting sulfur-containing coal in a combustion stage to which is provided at least 60% of the oxygen stoichiometrically required for substantially complete combustion of the coal and combustion is conducted under highly turbulent conditions in a furnace burner cavity to which finely divided iron oxide and/or iron powder is provided and in which a high heat release rate is maintained to form a liquid iron oxysulfide phase which acts to scrub sulfur-containing gaseous species from the combustion atmosphere and is separated from the combustion atmosphere with substantially the sulfur originally contained in the coal. Following separation, the hot fuel gas resulting is burned to completion in a heat exchanging furnace, gas turbine or other energy extracting device.

16 Claims, 7 Drawing Figures

EQUILIBRIUM SULFUR CONTENT OF FLUE GASES IN CONTACT WITH $Fe_{1}S_{0.67}O_{x}$ LIQUID

COAL COMBUSTION TO PRODUCE CLEAN LOW-SULFUR EXHAUST GAS

This invention is directed to a process for combusting sulfur-containing coal to produce a stack off-gas of greatly reduced sulfur dioxide content.

BACKGROUND OF THE INVENTION AND THE PRIOR ART

The burning of coal provides a major source of electric power in the United States. It has increasingly become apparent that coal-burning power plants are a major source of the pollutants, including $SO_2$ and $NO_x$, which are responsible for damage to fish and plant life in the northeastern part of the country and in Canada due to the phenomenon now known as "acid rain." The acid rain problem is complex, and the steps necessary to control the problem are not easy to accomplish. For example, coal is the most abundant source of fossil fuel and will be available long after the earth's available petroleum supply is exhausted. Unfortunately, most of the coal supplies in the Eastern and Midwestern United States are high in sulfur, and substitution of lower-sulfur Western coals, therefore, is not only expensive because of transportation cost but can cause further distress in the already economically deprived coal-mining areas.

It is accordingly desirable that economic means be found whereby available high-sulfur coals could be utilized without further contributing to the atmospheric pollution problem.

It is known that numerous types of coal-burning apparatus are available for large-scale coal combustion for purposes such as steam generation. Thus, the cyclone burner was developed in the 1940's particularly for the purpose of burning an Illinois coal which has a high ash content and a low ash-fusion temperature. A paper entitled "Operating Experiences With Cyclone-Fired Steam Generators" by V. L. Stone and I. L. Wade which appeared in *Mechanical Engineering,* Vol. 74, 1952 at pages 359 to 368 describes operation of a power plant using cyclone burners. The book *Low-Rank Coal Technology; Lignite and Subbituminous* by Gronhovd and Sondreal of the Grand Forks Energy Technology Center and Kotowski and Wiltsee of the Energy Resources Company, Inc. published by the Noyes Data Corporation in 1982 provides further information. Gronhovd et al. point out that the cyclone furnace promotes complete combustion of coal in a high temperature, turbulent slagging environment and is applicable to all ranks of coal. Cyclone firing is considered to reduce the fly ash content of the flue gas. Heat release rates are extremely high, hence local temperatures are high and are sufficient to fuse the ash from most coals on the refractory walls of the cyclone.

Gronhovd et al. point out that the cyclone furnace is a water-cooled, refractory-lined cylinder. Crushed or pulverized coal and primary air are fed at the burner end of the furnace and secondary air is fed into the the cylinder tangentially, thus creating a whirling or cyclonic motion to gases within the cylinder. Coal particles are entrained in the high velocity stream and thrown against the furnace wall by centrifugal force where they are held in the molten slag layer. The high-velocity tangential stream of secondary air supplies combustion oxygen to the coal particles. Molten slag drains to the bottom of the furnace from which it is removed. The cyclone furnace is thus a slagging type of coal burner.

Reference may also be made to U.S. Pat. No. 2,745,732 which describes use of a cyclone type furnace under strongly reducing conditions to burn coal and to reduce and/or melt iron ores fed into the furnace. Sulfur and its disposal is not discussed in this patent.

Proposals have been known, as for example, U.S. Pat. No. 4,096,960 for gasifying high sulfur coal under strongly reducing conditions in an oxygen-jet fluid bed in the presence of lime (CaO) and iron oxide to fix sulfur as FeS and to produce a fuel gas. Turkdogan et al. in *Metallurgical Transactions,* (AIME), 2, 1971, 1561–1570 shows a melting diagram for the system iron oxide-iron sulfide in equilibrium with metallic iron.

The invention is directed to a process in which liquid iron oxide containing materials are used under controlled conditions as a sulfur sink to remove combustion-product sulfur compounds from flue gases generated by combustion of sulfur-containing coal at high temperatures and high rates to provide a cleaned flue gas which may be released harmlessly to the atmosphere.

BRIEF DESCRIPTION OF THE INVENTION

Fine high-sulfur coal and a sulfur-fixing material from the group consisting of iron oxide, iron and copper oxide are combusted in a burner cavity such as that of a cyclone furnace using at least about 60% of the oxygen stoichiometrically required for completely combusting said coal to form a liquid oxysulfide phase and a turbulent atmosphere of combustion-product gases, with the liquid oxysulfide acting to scrub sulfur-containing gaseous species from the furnace atmosphere to yield an essentially sulfur-free flue gas and a liquid oxysulfide slag containing essentially all the sulfur contained in the feed coal. Temperature conditions are maintained between about 1100° C. and 1500° C.

BREIF DESCRIPTION OF THE DRAWING

DETAILED DESCRIPTION OF THE INVENTION

Figure 1:
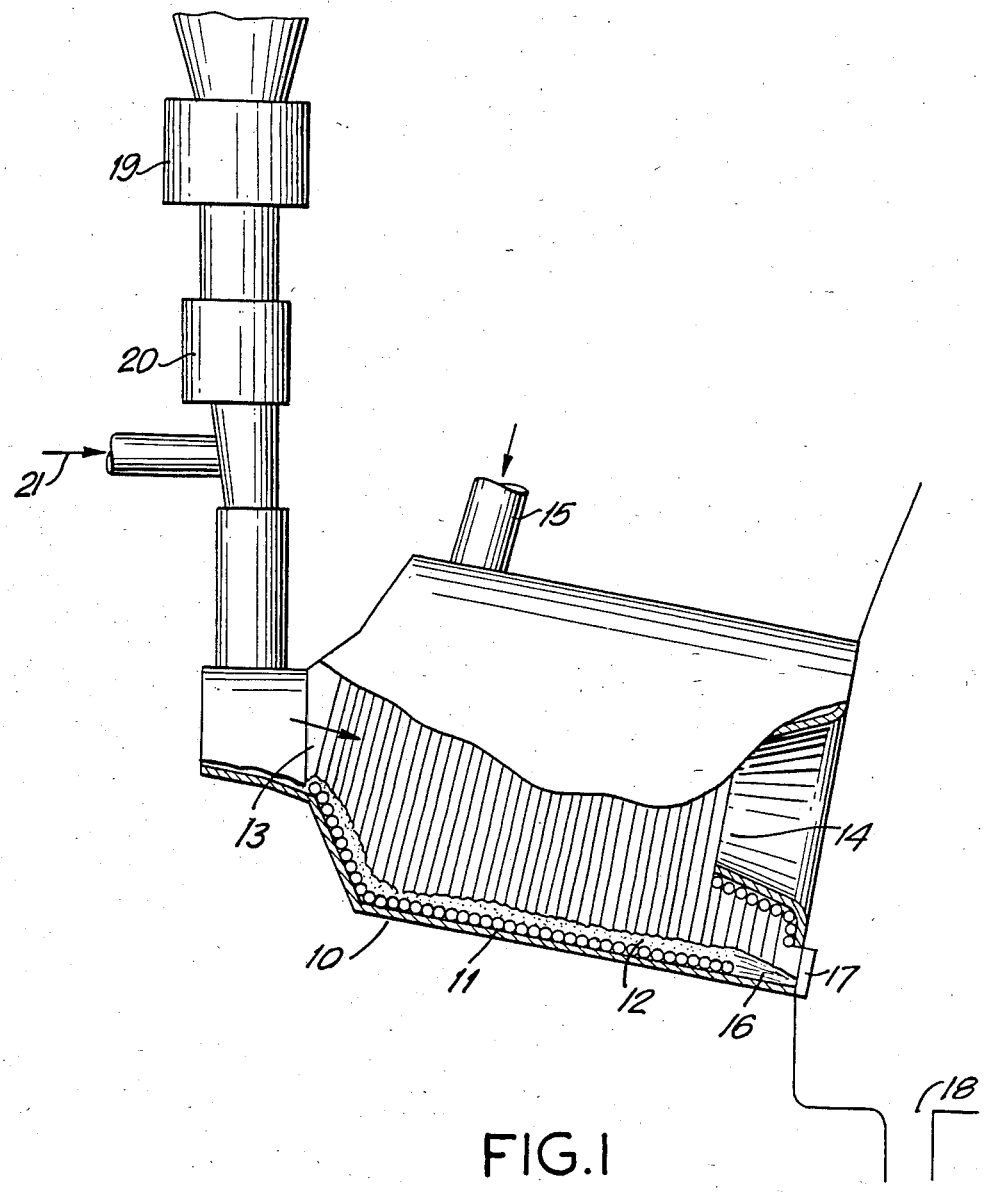
FIG. 1 illustrates a cyclone furnace usable in accordance with the invention.

The invention will now be described in conjunction with the drawing in which reference character 10 depicts in partial section the steel shell of a horizontal cyclone furnace which is protected on the inner circumferential surface with steel tubes 11 adapted to carry cooling water. Refractory lining 12 which may, for example, comprise frozen slag derived from the ash content of coal combusted in the furnace overlies tubes 11 as a protection against abrasion and corrosion. Reference character 13 depicts an opening through which pulverulent coal and primary air may be fed into the furnace. Reentrant opening 14 enables exit of hot combustion-product gas while inhibiting escape of fly ash. Secondary air, usually at substantial pressure and preferably preheated to circa 600° C. is admitted through tangentially-located opening 15. A sump 16 is provided for the collection of molten slag, which flows thence through tap hole 17 to the slag tank indicated at 18. In operation, coal from a bunker, not shown, which has been crushed and/or pulverized to −4 mesh and finer is weighed continuously in coal scales 19 and fed through coal feeder 20. Pulverulent sulfur-fixing material which may be an iron-containing material, e.g., taconite, mill scale or other iron oxide or iron powder may be introduced at one of several places. Conveniently, the iron oxide, in metered amounts, is mixed, and introduced into the furnace, with the coal. Copper oxide may also be used as a sulfur-fixing material. Primary air is introduced at 21, and the mixture of primary air and pulverulent coal is fed into the furnace at 13.

It is to be appreciated that conditions within the furnace are highly turbulent and that high velocities as well as high gas temperatures are generated. As the mixture of pulverulent coal and fine iron oxide is fed into the hot, turbulent, combustion zone, combustion of the coal proceeds rapidly. For purposes of the invention at least about 60% of the oxygen stoichiometrically required to combust the coal must be supplied in order for desulfurization of the gases present in the combustion space to proceed rapidly. The myriad small iron oxide particles introduced with the coal fill the combustion space with a cloud of scrubbing medium. The particles rapidly are heated to incandescence and as the reaction with sulfur species in the combustion space occurs, the particles melt thus providing a liquid scrubbing medium. Kinetics of the desulfurization reaction are greatly enhanced when the sulfur acceptor is a liquid phase. The necessity for combustion conditions to be relatively oxidizing, i.e., approaching neutral, facilitates combustion of the coal. The cyclonic gas path promotes scrubbing of the gas with liquid oxysulfide, e.g., iron oxysulfide, particles which for the most part become deposited in the molten slag layer on the furnace walls along with the other slag-forming ingredients present in the ash content of the coal being burned. When the oxysulfide particles become lodged in the slag layer, they are diluted with silica and other oxides present in the slag, thereby lowering the activity of the oxysulfide and improving its sulfur-fixing capability.

The principal reactions occurring during the controlled combustion needed to produce desulfurization in accordance with the invention include the following:

$$CO + \tfrac{1}{2}O_2 \rightleftharpoons CO_2 \quad (1)$$

$$CO_2 + H_2 \rightleftharpoons H_2O + CO \text{ (water-gas reaction)} \quad (2)$$

$$H_2 + \tfrac{1}{2}S_2 \rightleftharpoons H_2S \quad (3)$$

while the equilibrium $$2CO \rightleftharpoons CO_2 + C, \quad (4)$$

may be involved, complete combustion of the coal is assured and carbon is thus not an equilibrium phase.

It may be noted that the water-gas shift reaction yields an equilibrium constant moving to lower hydrogen contents at higher temperatures; thus $$K_{water\ gas} = \frac{PH_2O}{PCO_2} \cdot \frac{PCO}{PH_2}$$

At 1000° C. K w.g. is 1.646, while at 1100° C. it is 2.010, at 1200° C. it is 2.594, and at 1300° C. it is 3.119.

The resulting reduction in hydrogen level for a given ratio of partial pressures of $CO_2$ to CO, tends to compensate for increasing sulfur pressure over the condensed phases to reduce the pressure of the $H_2S$ via the equilibrium $$K_3 = \frac{PH_2S}{PH_2} \cdot PS_2\,\tfrac{1}{2}$$

The effective liquid iron oxysulfide may be considered to have the composition range $FeO_xS_y$, where 1 x 1.33 and 0 y 1.

This composition is kept stable in the combustion zone by control of the ratio of reducing constituents, primarily the $CO_2/CO$ ratio.

Figure 2:
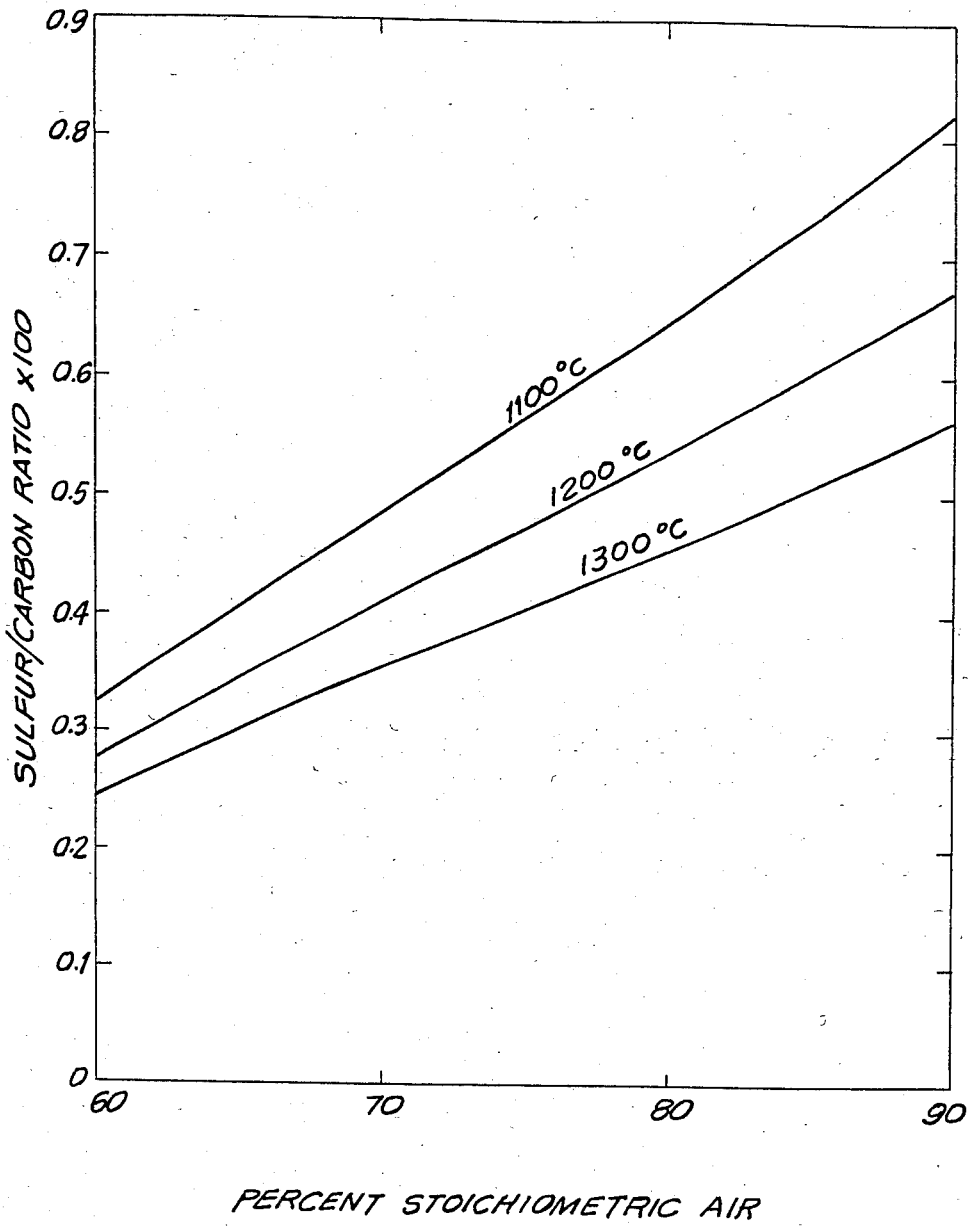
FIG. 2 is a graph depicting the equilibrium sulfur content of flue gases in contact with a liquid iron oxysulfide of the formula $FeS_{0.67}O_x$ at various temperatures.

FIG. 2 gives the calculated equilibrium sulfur contents of flue gases in contact with liquid Fe $S_{o.67}$ $O_x$ at temperatures of 1100°, 1200° and 1300° C. based on a coal having an atomic ratio of hydrogen to carbon of 1:1, a sulfur content of 4% and a carbon content of 60%, by weight, i.e., a sulfur-to-carbon ratio of 0.067 in the coal and combustion in which 60 to 90 percent of stoichiometric air requirement is supplied. At 60% stoichiometric air the sulfur to carbon ratio of the resulting gas ranges from 0.0035 to 1300° C. to 0.0032 at 1100° C. This indicates a removal from the gas of 95% or more of the sulfur originally contained in the coal. FIG. 2 also indicates that higher temperatures improve the thermodynamic efficiency. This factor is highly favorable since high temperatures rapidly increase kinetics and provide greater fluidity in the liquid phase. FIG. 2 also shows that as the oxygen level is increased, measured by percent stoichiometric air, the equilibrium level of sulfur in the gas phase also increases. Despite this factor a 91% removal of sulfur from the coal is still indicated at 1300° C., the case shown at 90% stoichiometric air. At this point the value of "x" in the formula Fe $S_{o.67}$ $O_x$ approaches 1.3 and the sulfur to carbon ratio in the gas phase approaches 0.0057. At 1200° C. a range of gas compositions as measured by the ratio $CO_2/CO$ from 0.3/1 to greater than 10/1 are possible for stabilization of the oxysulfide liquid phase.

Figure 3:
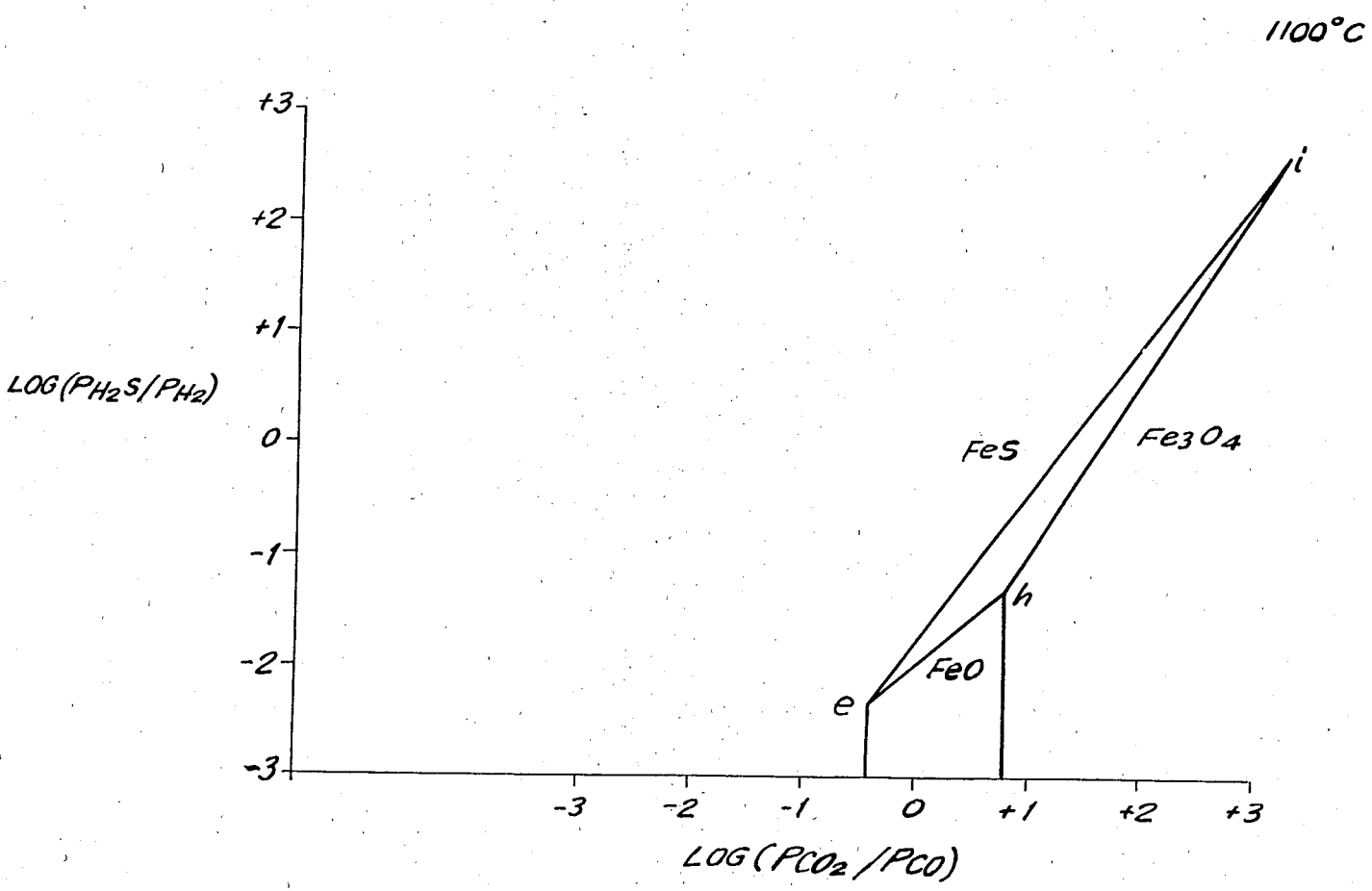
FIG. 3 depicts the liquid phase area for liquid iron oxysulfide compositions in stable equilibrium with gas phases plotted as log ($PH_2S/PH_2$) and log ($PCO_2$/-PCO) at 1100° C.
Figure 4:
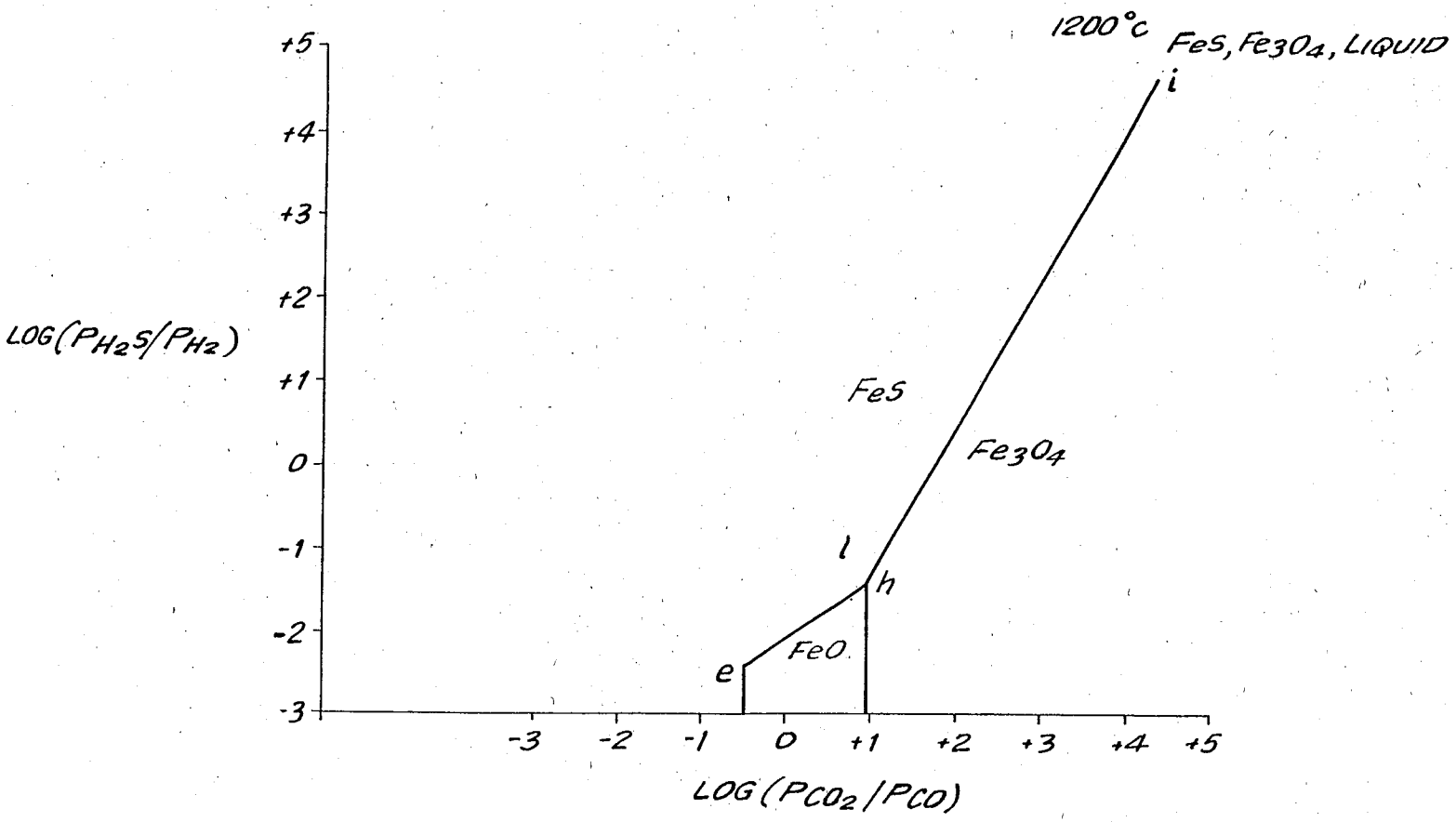
FIG. 4 is a plot constructed on the same basis as FIG. 3 but at 1200° C.
Figure 5:
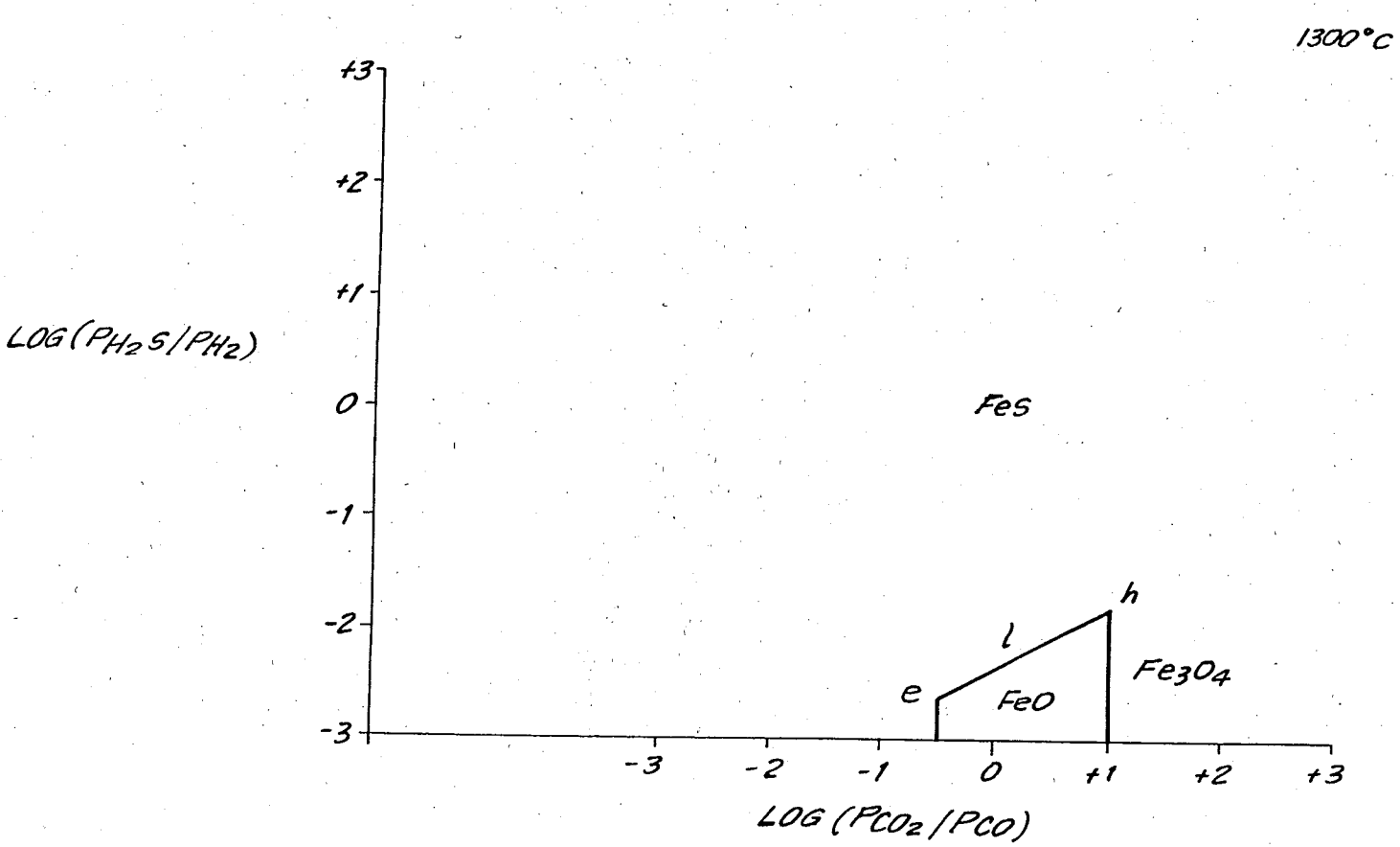
FIG. 5 is a plot constructed on the same basis as FIG. 3 but at 1300° C.

On FIGS. 3, 4 and 5 are plotted the area representing substantially the liquid phase area in equilibrium with the gas atmosphere. The Figures demonstrate that the significant gas phase species to be controlled for stabilizing the liquid phase are hydrogen sulfide, hydrogen, carbon dioxide and carbon monoxide.

In the Figures equilibrium "e" (gas, iron, wustite, liquid) and equilibrium "h" (wustite, magnetite, liquid) represent the extremes of oxygen potential bounding the lower range for the liquid phase. Equilibrium "h" does not exist at temperatures below 942° C. The point "h" in the Figures separates FeO (wustite) from $Fe_3O_4$ (magnetite), and it is undesirable to attempt operation at $CO_2/CO$ ratios above point "h" as $H_2S$ then ceases to be a primary gas species. Instead, $SO_2$ becomes the sulfur-bearing gas species. The $FeO/Fe_3O_4$ boundary gives the useful limit to $PCO_2/PCO$ values.

Having regard for the information presented in the Figures, it can be seen that, in order to control the desulfurizing process, temperature is first established after which the ratios $PCO_2/PCO$ and $PH_2S/PH_2$ are measured and controlled to stay within the liquid region. For this purpose, coal rate, air rate and rate of iron oxide addition are controlled. As noted previously, it is desirable to blend the coal and iron oxide streams. Preferably, the particle size of the coal is in a range between about one micron and about 100 microns and the iron oxide particle size is controlled in the range of about one micron to about 100 microns, e.g., minus 200 mesh. Iron oxide preferably is fed at rates of about 25% to about 100% excess of the stoichiometric quantity required to produce FeS based on the sulfur content of the feed coal.

Thermodynamic efficiency of the desulfurization process is improved since wustite serves as a diluent or solvent for FeS and reduces the $H_2S$ pressure in equilibrium with the liquid, thereby contributing further to desulfurization of the gas.

With the thermodynamic information available, it became possible to calculate gas compositions at the temperatures of interest. In the calculations, the effect of carbon on the liquid phase was neglected. The interaction coefficient is positive, indicating that carbon tends to raise the activity of sulfur. A beneficial effect of carbon would be to lower the melting point of the liquid and hence increase its fluidity at a given temperature. The beneficial role of silica and other components in reducing the activity of the liquid was also neglected. Data from literature (Robie, R. A. et al. in "Thermodynamic Properties of Minerals and Related Substances at 298.15 K and 1 Bar ($10^5$ Pascals) Pressure and at Higher Pressures"; *U.S.G.S. Bulletin* 1452, 1979) on free energy of reaction were used in calculating log ($PCO_2/PCO$) and log ($PH_2S/PH_2$)

Reaction (1) $CO + \frac{1}{2}O_2 \rightleftharpoons CO_2$
Reaction (2) $CO_2 + H_2 \rightleftharpoons H_2O + CO$
Reaction (3) $H_2 + \frac{1}{2}S_2 \rightleftharpoons H_2S$ $$F.^\circ(1) = -RT\ln\frac{PCO_2}{PCO.(PO_2)^{\frac{1}{2}}} = -RT\ln\frac{PCO_2}{PCO} + \tfrac{1}{2}RT\ln PO_2$$

$$F.^\circ(2) = -RT\ln\frac{PH_2O.PCO}{PCO_2.PH_2};\ \frac{PH_2O}{PH_2} = K_{(2)}\cdot\frac{PCO_2}{PCO}$$

$$F.^\circ(3) = -RT\ln\frac{PH_2S}{PH_2(PS_2)^{\frac{1}{2}}} = -RT\ln\frac{PH_2S}{PH_2} + \tfrac{1}{2}RT\ln PS_2$$

| T K.° | F.° (1) Calories | F.° (2) Calories | F.° (3) Calories | t °C. |
|---|---|---|---|---|
| 1273 | −41,097 | −1,370 | −6,691 | 1000 |
| 1373 | −39,038 | −1,950 | −5,506 | 1100 |
| 1473 | −36,995 | −2,629 | −4,312 | 1200 |
| 1573 | −34,959 | −4,769 | −3,136 | 1300 |

These data were used to calculate $PCO_2/PCO$ and $PH_2S/PH_2$ for equilibrium "e" (Fe/FeO/l/g) and "h" ($FeO/Fe_3O_4$/l/g) as defined in FIG. 3 as follows in Table 1:

TABLE 1

| t °C. | Equi-libria | $-RT\ln PO_2$ k cal | $-RT\ln PS_2$ k cal | $\log\frac{PCO_2}{PCO}$ (calc.) | $\log\frac{PH_2S}{PH_2}$ (calc.) |
|---|---|---|---|---|---|
| 1000 | e | 86.0 | 40.5 | −0.329 | −2.328 |
| 1000 | h | 73.9 | 28.2 | +0.710 | −1.264 |
| 1100 | e | 83.1 | 40.6 | −0.400 | −2.356 |
| 1100 | h | 67.7 | 27.3 | +0.834 | −1.297 |
| 1200 | e | 80.0 | 41.4 | −0.446 | −2.431 |
| 1200 | h | 61.4 | 28.1 | +0.934 | −1.443 |
| 1300 | e | 77.0 | 44.0 | −0.492 | −2.622 |
| 1300 | h | 54.5 | 32.4 | +1.0712 | −1.815 |

A Leahy coal of the composition below was selected for illustrative purposes:

Leahy Coal:
4.75% $H_2O$ (percents below on moist basis)
67.19% C
4.85% H
1.52% N (neglected in calculations)
2.77% S
Balance non-volatile constituents. Basis taken:
100 grams of coal.
let x = moles of CO in gas phase
let (5.60 − x) = moles $CO_2$ in gas phase
let y = moles $H_2$ in gas phase
let (2.69 − y) = moles $H_2O$ in gas phase $$O_2 \text{ needed} = \frac{x}{2} + (5.60 - x) + \frac{(2.69 - y)}{2} - \frac{0.264}{2}$$

$$N = \frac{79}{21} \times O_2 \text{ (added as air)}$$

The Leahy coal was calculated to yield a flue gas containing 2620 ppm of $SO_2$ when completely combusted without added iron oxide. With iron oxide, the following results became predictable:

TABLE 2

| Summary of Results - Leahy Coal | | | | |
|---|---|---|---|---|
| t °C. | 1000 | 1100 | 1200 | 1300 |
| Equilibrium (e) Gas, Iron Wustite Liquid Volume % | | | | |
| CO | 15.9 | 16.7 | 17.2 | 17.7 |
| $CO_2$ | 7.5 | 6.6 | 6.2 | 5.7 |
| $H_2$ | 6.3 | 9.1 | 9.9 | 4.6 |
| $H_2O$ | 4.9 | 2.1 | 1.4 | 6.7 |
| $H_2S$ (ppm) (Bal $N_2$) | 300 | 402 | 365 | 109 |
| Equilibrium (h) Gas, Wustite Magntite, Liquid Volume % | | | | |
| CO | 2.9 | 2.3 | 1.8 | 1.1 |
| $CO_2$ | 14.6 | 15.2 | 15.4 | 12.3 |
| $H_2$ | 0.9 | 0.6 | 0.4 | 0.1 |
| $H_2O$ | 7.5 | 7.8 | 7.9 | 6.3 |
| $H_2S$ (ppm) (Bal $N_2$) | 475 | 289 | 135 | 18 |

An examination of the foregoing Table 2 reveals that at higher temperature and higher $CO_2$ contents, the $H_2S$ concentration tends to drop. This is due to the water-gas equilibrium:

$$PH_2 = \frac{1\ (PH_2O)\ (PCO)}{Kw \cdot g\ PCO_2}$$

For high values of K w.g. and $PCO_2$, the pressure of hydrogen drops. As the hydrogen pressure drops, the $H_2S$ pressure also drops.

This observation has practical applications with respect to the combustion process. It means combustion can be conducted at relatively high oXygen potentials ($PCO_2/PCO$ of ten to one) at high temperatures ($T > 1250°$ C.) and still achieve a high degree of desulfurization ($PH_2S < 200$ ppm). At higher temperatures kinetics are more favorable, and also at high oxygen potentials there is a much better outlook for complete gasification of carbon to CO and $CO_2$. At 90% removal of sulfur the flue gas would contain about 260 ppm $H_2S$.

If, however, a 4% sulfur coal is used, the thermodynamics remain unchanged, yet the calculations yield essentially the same sulfur levels. Therefore, the ultimate percent sulfur removal which can be achieved increases.

The presence of pyrite in the coal is not necessarily a "bad" circumstance since it will, with excess iron oxide addition be converted to an oxy-sulfide (although $FeS_2$ does decompose upon heating to FeS and S). High temperature kinetics can be fast enough so that the gas phase is essentially "gettered" of sulfur close to the equilibrium levels. The final burner design and burner cavity should be constructed to maximize rate of coal combustion, maximize liquid droplet/gas contact, and remove spent liquid phase before it becomes saturated with sulfur. Since this oxysulfide liquid has the potential of being highly corrosive to refractory walls, external cooling of the walls to maintain a frozen interface is essential.

The known operating characteristics of the cyclone furnace over many years indicate that the foregoing criteria are met thereby.

Examples will now be given:

EXAMPLE 1

Figure 6:
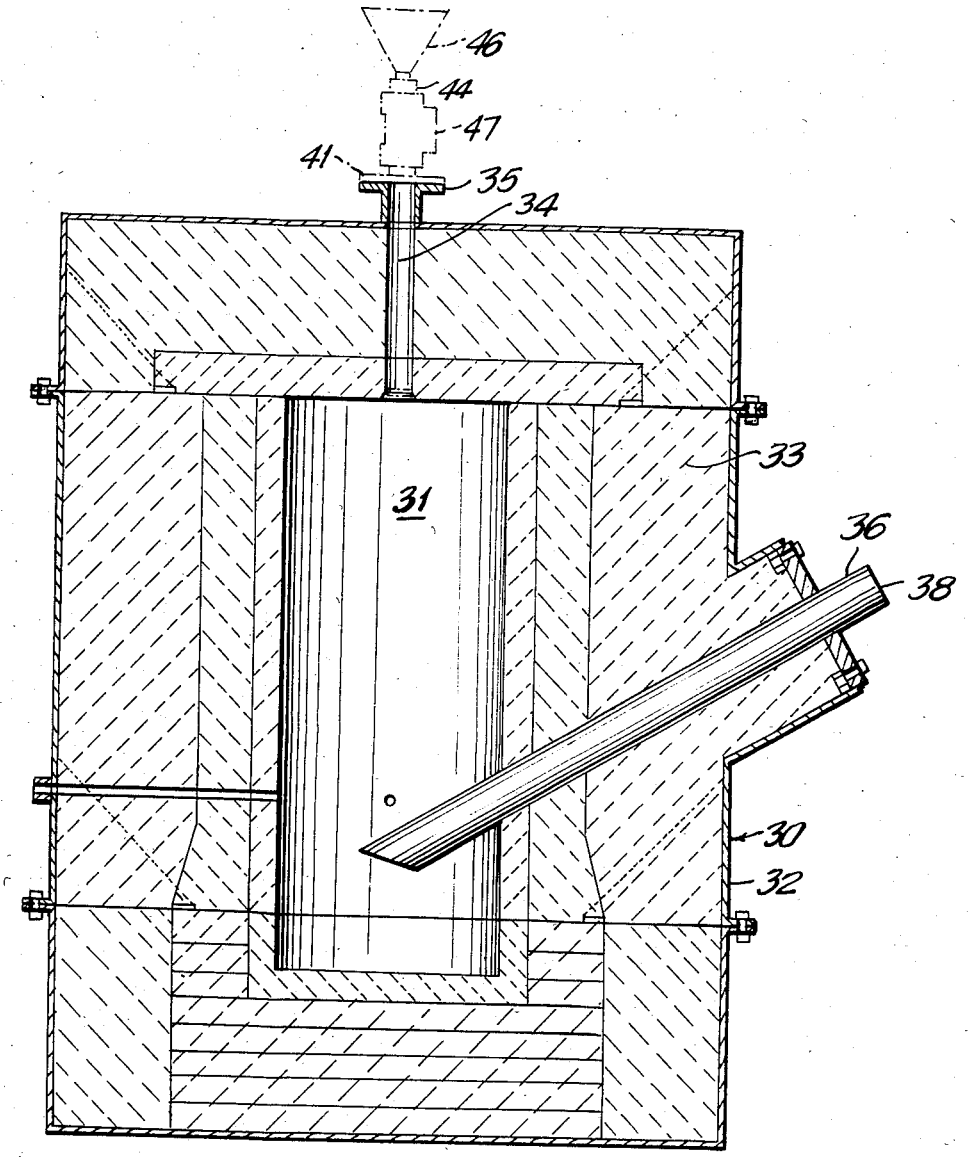
FIG. 6 is a sketch of an experimental furnace constructed to test the concepts of the invention.

A furnace 30 having an internal cavity 31 essentially configured as an upright cylinder with a volume of about 128 liters as shown in FIG. 6 was constructed. Furnace 30 was made as a steel shell 32 lined with refractory brick 33. Throat 34 located on the vertical axis of cavity 31 was designed to contain a coal burner supported on flange 35 which delivered a turbulent burning mixture of fine coal, air and combustion gas to the interior of cavity 31. Exhaust 36 designed at the intake end 37 to avoid short circuiting of the combusting mixture and to conduct gaseous combustion product from the interior of the free space or cavity 31 to an afterburner (not shown) mounted about the outer end 38 was provided, in which carbon monoxide remaining in the furnace off-gas was completely combusted.

Figure 7:
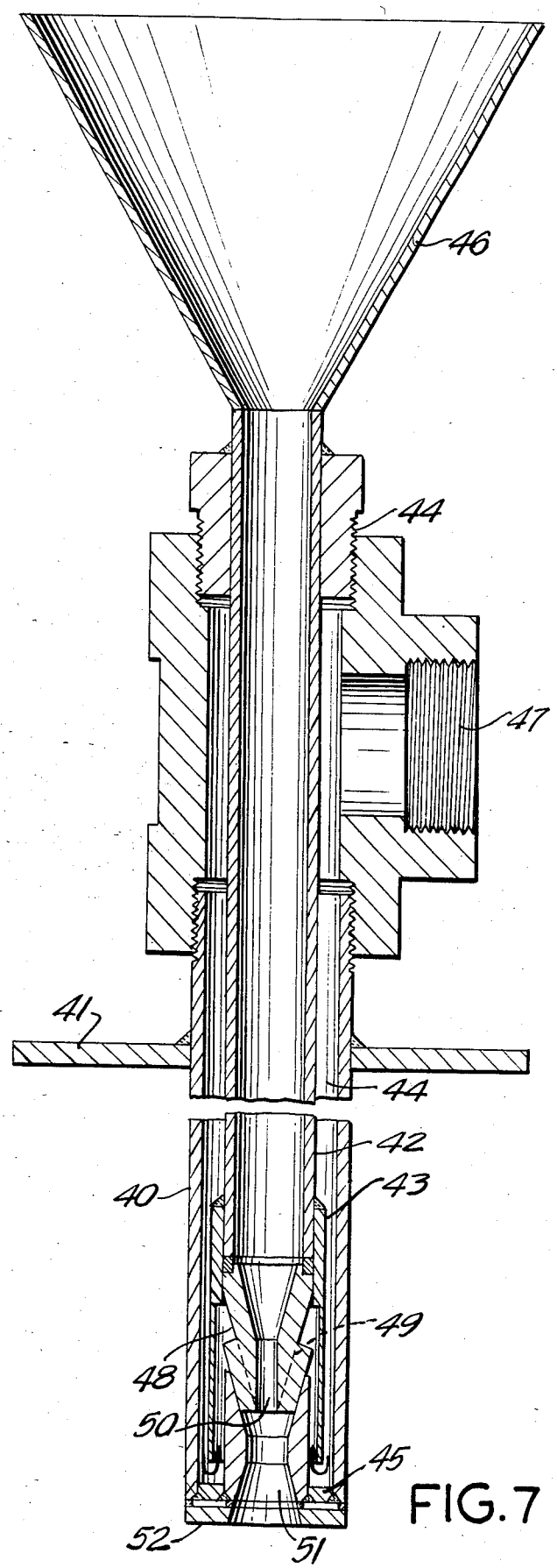
FIG. 7 is a sketch of a coal burner used to fire the furnace of FIG. 6.

FIG. 7 depicts in section the coal burner used in conjunction with the furnace of FIG. 6. The burner comprises a cylindrical body 40 designed to fit within throat 34 of furnace 30 and to be supported on flange 41. The burner has concentric inner and outer tubes 42 and 43 forming an air feed ring 44 therebetween. The tubes 42 and 43 are spaced apart and sealed at upper and lower ends by seals 44 and 45. Funnel 46 is provided at the top of tube 42 to facilitate feeding coal or a mixture of coal with iron and/or iron oxide powders. Air is fed at 47. Coal and air are mixed by the stationary mixer 48 provided with helical grooves 49 to which air is fed. Air fed through grooves 49 aspirates particulate coal or coal/iron/iron oxide mix through throat 50 and the mixture is forced through venturi throat 51 into the top of furnace 30. The bottom end of burner 40 comprising a radiation shield 52, is almost coincident with the inner top refractory face of furnace cavity 31. The helical placement of air grooves 49 imparts a turbulent swirling motion to the combusting mixture entering the free space of the furnace. Due to the small size of the furnace, no slag drain was provided.

A series of runs was made using the apparatus of FIGS. 6 and 7. The volume of the furnace cavity was about 128 liters. It was found that when particulate coal was fed at a rate of about 50 grams per minute with sufficient added air for partial combustion that a temperature of about 1250° C. could be maintained in the furnace cavity 31 while producing an off-gas containing about 7% carbon monoxide, by volume.

In the tests, a Chinook coal analyzing 1.2% $H_2O$, 67.8% C., 5.3% H, 2.3% Fe, 4.89% S ground such that about 95% passed a −325 mesh screen was used. It was estimated that residence time of a coal particle under the conditions used was approximately 5 seconds. Furnace off-gas was burned to completion stoichiometrically in an afterburner and was then analyzed for sulfur dioxide. Coal feed and process air were adjusted to the burner cavity using an infrared carbon monoxide analyzer. The calculated "base case" for complete combustion of the coal resulted in a theoretical stoichiometric stack gas $SO_2$ concentration of 4700 parts per million. In Test M, coal was burned under conditions for complete combustion resulting in a measured stoichiometric stack gas $SO_2$ concentration of 4300 parts per million. In Test N some residual added iron was present in the combustion chamber and a small amount of sulfur was removed. In Tests A, C and E about 27% if sulfur was rejected to iron in the coal ash. In Tests F, B and D iron was premixed with the coal as hematite having a particle size of about two microns and up to 53% of the sulfur was rejected. In Test H, magnetite having a particle size of about 30 microns was used with results similar to the hematite results. In tests P, Q and L magnetite and iron powders, mixed in the FeO proportion, provided stack gas $SO_2$ concentrations as low as 1400 parts per million, representing a sulfur removal of up to 70%. All results are reported in the following table:

| Test | Feed | Mass Fed, g | Rate Coal, g/min (Coal Only) | % CO (Cavity) | T, °C. | Process Air, g mol/min | Total Air, g mol/min | $SO_2$ Assay, ppm (Dry Basis) | Sulfur Removed, % | Ratio of Process Air to Total Air | Estimated Air In-Leakage % |
|---|---|---|---|---|---|---|---|---|---|---|---|
| Base | Coal | — | 35 | 0 | — | 11.9[1] | 11.9[1] | 4,700[1] | 0 | 1.00 | 0 |
| M | Coal | 1,300 | 56.5 | 0 | 1,315 | 19.2 | 19.2 | 4,300 | 8 | 1.00 | 0 |
| N | Coal | 1,200 | 50 | 0 | 1,340 | 14.0 | 14.0 | 4,100 | 13 | 1.00 | 21 |
| A | Coal | 1,200 | 46 | 7 | 1,250 | 9.4 | 14.0 | 3,550 | 25 | 0.67 | 11 |
| C | Coal | 1,400 | 50 | 7 | 1,230 | 9.4 | 14.0 | 3,400 | 28 | 0.67 | 21 |
| E | Coal | | 40 | 7 | 1,250 | 8.3 | 11.8 | 3,250 | 31 | 0.70 | 15 |
| F | 80% | 1,400 | 37 | 7 | 1,240 | 5.8 | 11.0 | 2,700 | 43 | 0.53 | 15 |

-continued

| Test | Feed | Mass Fed, g | Rate Coal, g/min (Coal Only) | % CO (Cavity) | T, °C. | Process Air, g mol/min | Total Air, g mol/min | $SO_2$ Assay, ppm (Dry Basis) | Sulfur Removed, % | Ratio of Process Air to Total Air | Estimated Air In-Leakage % |
|---|---|---|---|---|---|---|---|---|---|---|---|
| | Coal 20% $Fe_2O_3$ | | | (% $CO_2$ = 10.1) | | | | | | | |
| B | Same as F | 1,400 | 35 | 7 | 1,230 | 6.5 | 12.5 | 2,200 | 53 | 0.52 | −5 |
| D | Same as F | 1,400 | 59 | 7 | 1,220 | 9.4 | 14.0 | 3,600 | 23 | 0.67 | 44 |
| O | 80% Coal 20% $Fe_3O_4$ | 1,250 | 40 | 3 | 1,250 | 9.8 | 13.1 | 3,150 | 33 | 0.75 | 4 |
| H | Same as O | 1,400 | 45 | 7 | 1,250 | 8.7 | 12.8 | 2,508 | 47 | 0.68 | 20 |
| P | 80% Coal 16.9% $Fe_3O_4$ 3.1% Fe | 3,500 | 31 | 7 | 1,250 | 5.2 | 9.8 | 1,400 | 70 | 0.53 | 7 |
| Q | Same as P | 3,400 | 34 | 7 | 1,320 | 6.3 | 10.5 | 1,700 | 64 | 0.60 | 10 |
| L | Same as P | 1,350 | 49 | 7 | 1,240 | 8.3 | 15.1 | 1,700 | 64 | 0.55 | 11 |

Note: [1]Base Case.

EXAMPLE 2

A cyclone furnace as illustrated in FIG. 1 of the drawing having a diameter of eight feet and a length of 11 feet is brought up to temperature of about 1300° C. by firing with natural gas and stoichiometric air. Slagging ingredients are introduced to form a slag coating on the furnace walls which coating becomes frozen in contact with the water cooled tubes lining the wall to form a protective layer. Firing is then commenced using a pulverized coal containing about 4% sulfur, about 40% volatiles, about 39% fixed carbon, about 9% ash and about 12% moisture. Particle size of the coal is about 20 microns. Coal is fed at a rate of 100,000 pounds per hour, mixed with about 15,000 pounds per hour of fine taconite having a particle size of about minus 20 mesh. Air preheated to about 600° C. at about 90% of the stoichiometric requirement for complete combustion of coal is fed at a rate of about ten million standard cubic feet per hour. Hot product gas having a sulfur dioxide content of about 1000 ppm and an average temperature of about 1100° C. is fed to an electric utility boiler to raise steam. Removal of about 80% of the sulfur content of the coal is achieved. Slag at a rate of about 26,000 pounds per hour (including pyritic iron from the coal) is led to the slag tank and is then granulated with water and pumped to disposal.

The process of the invention provides a means for reducing the amount of sulfur dioxide released to the atmosphere from the combustion of sulfur-containing coal. Furthermore, since combustion is accomplished in the presence of a reduced oxygen partial pressure, the amounts of $NO_x$ are reduced as compared to conventional practice. It is of course desirable to accomplish combustion as rapidly as possible so as to secure reaction between molten iron oxysulfide droplets and sulfur species in the combustion atmosphere. Thus, fine coal, preheating of the air supply to about 600° C. e.g., about 200° to about 700° C. and possibly oxygen enrichment are all beneficial. Another advantage of the invention is that the removed sulfur is fixed in a dense inert solid thereby avoiding disposal problems.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The process for combusting sulfur-containing coal while producing of off-gas low in sulfur which comprises combusting particulate coal in a furnace burner cavity providing rapid coal combustion, a hot, turbulent combustion zone and a combustion temperature of at least about 1100° C. in the presence of a finely divided sulfur-fixing material from the group consisting of iron oxide, iron powder and copper oxide in amounts about 25% to about 100% in excess of the stoichiometric quantity required to produce metal sulfide based on the sulfur content of said coal distributed throughout said combustion zone and at least about 60% of the oxygen stoichiometrically required for complete combustion of said coal to form a particulate liquid oxysulfide phase within a turbulent atmosphere of combustion-product gases, said liquid oxysulfide acting to scrub sulfur-containing gaseous species from said atmosphere to yield an essentially sulfur-free flue gas and a liquid oxysulfide slag containing essentially all the sulfur originally contained in said coal.

2. The process in accordance with claim 1 wherein said liquid oxysulfide is iron oxysulfide and is controlled essentially to the proportions $FeO_xS_y$ wherein $1<x<1.33$ and $o<y<1$.

3. The process in accordance with claim 1 wherein said liquid oxysulfide slag is removed from contact with said combustion-product gas before said oxysulfide is saturated with sulfur.

4. The process in accordance with claim 1 wherein said burner cavity is provided in a flash furnace.

5. The process in accordance with claim 1 wherein said burner cavity is provided in a cyclone type furnace.

6. The process in accordance with claim 1 wherein the temperature within said furnace atmosphere is at least about 1100° C. and the ratios of coal feed, oxygen feed and sulfur-fixing material feed are controlled by measuring the contents of carbon dioxide and carbon monoxide, and controlling the ratio of carbon dioxide and carbon monoxide to maintain within said burner cavity a liquid oxysulfide phase and an atmosphere of reduced sulfur content in contact with said phase; and removing said liquid oxysulfide from said burner cavity before said oxysulfide becomes saturated with sulfur.

7. The process in accordance with claim 1 wherein said coal and sulfur-fixing material are uniformly mixed before being fed to said furnace.

8. The process in accordance with claim 1 wherein said oxygen is supplied as air.

9. The process in accordance with claim 1 wherein said iron oxide is supplied as taconite.

10. The process in accordance with claim 1 wherein said sulfur-fixing material is iron powder and said oxysulfide is iron oxysulfide.

11. The process in accordance with claim 1 wherein said sulfur-fixing material is iron oxide and said oxysulfide is iron oxysulfide.

12. The process in accordance with claim 1 wherein said sulfur-fixing material is copper oxide.

13. The process in accordance with claim 6 wherein said liquid oxysulfide is removed from said combustion zone by deposition upon the walls of said burner cavity.

14. The process in accordance with claim 13 wherein ash present in said coal is codeposited with said oxysulfide.

15. The method for combusting sulfur-containing coal while producing a substantially sulfur-free combustion-product gas and fixing essentially all the sulfur content of said coal in a sulfidic slag which comprises mixing the sulfur-containing coal to be combusted with a finely-divided sulfur-fixing material from the group consisting of iron oxide, iron powder and copper oxide, said sulfur-fixing material being stoichiometrically in excess of the sulfur content of said coal and combusting said mixture along with at least about 60% of the oxygen stoichiometrically required for complete combustion of said coal in a turbulent combustion zone at a temperature of about 1100° C. to about 1500° C. wherein high combustion gas velocities are maintained and wherein the particles of said sulfur-fixing material rapidly incandesce and react with gaseous sulfur species in said combustion gas to form a myriad of liquid oxysulfide particles which scrub sulfur-containing species from said combustion zone to yield an essentially sulfur-free combustion-product gas and a liquid oxysulfide slag containing essentially all the sulfur originally contained in said coal.

16. The method in accordance with claim 15 wherein the gas containing said oxygen is preheated.

* * * * *